US008534483B1

(12) United States Patent
Rodriguez

(10) Patent No.: US 8,534,483 B1
(45) Date of Patent: Sep. 17, 2013

(54) DECORATIVE SORT CAN RECYCLING SYSTEM

(76) Inventor: Laura Rodriguez, Lodi, CA (US)

( * ) Notice: Subject to any disclaimer, the term of this patent is extended or adjusted under 35 U.S.C. 154(b) by 0 days.

(21) Appl. No.: 13/536,977

(22) Filed: Jun. 28, 2012

Related U.S. Application Data

(60) Provisional application No. 61/509,429, filed on Jul. 19, 2011.

(51) Int. Cl.
*B65D 21/02* (2006.01)

(52) U.S. Cl.
USPC ..... 220/23.88; 220/528

(58) Field of Classification Search
USPC ..... 220/23.88, 527, 528, 486, 485, 909, 220/908.1, 908; D34/8, 7, 1
IPC ..... B65D 21/00
See application file for complete search history.

(56) References Cited

U.S. PATENT DOCUMENTS

| | | | | |
|---|---|---|---|---|
| 1,848,331 | A * | 3/1932 | Esslinger | 220/553 |
| 3,904,218 | A | 9/1975 | Kostic et al. | |
| 4,834,253 | A | 5/1989 | Crine | |
| 5,111,958 | A * | 5/1992 | Witthoeft | 220/524 |
| D333,369 | S | 2/1993 | Breen et al. | |
| 5,390,813 | A | 2/1995 | Anderson et al. | |
| 5,558,254 | A * | 9/1996 | Anderson et al. | 220/527 |
| 5,878,904 | A | 3/1999 | Schweigert | |
| D423,168 | S | 4/2000 | Studstill | |
| 6,626,321 | B2 * | 9/2003 | Jaeger | 220/571 |
| 7,703,622 | B1 * | 4/2010 | Bynoe | 220/263 |
| 2004/0206760 | A1 * | 10/2004 | Gagnebin | 220/495.04 |

FOREIGN PATENT DOCUMENTS

DE 3517262 C1 * 8/1986

* cited by examiner

*Primary Examiner* — Robert J Hicks
(74) *Attorney, Agent, or Firm* — RG Patent Consulting LLC; Rachel Gillboy

(57) ABSTRACT

An apparatus for separately storing recyclable and/or disposable refuse in separate inner containers within one outer receptacle. Two nestable and duplicate interior recycle can inserts are used to separate the refuse. One interior recycle can insert may store the recyclable refuse and the second interior recycle can insert may store the disposable refuse until they are ready for emptying. Each interior recycle can insert tapers from the top periphery to the lower periphery to facilitate easy insertion and removal from the outer receptacle. Each interior recycle can insert has air holes to equalize relative air pressure such that the interior recycle can inserts may be easily removable from the outer receptacle. Each interior recycle can insert has cut-out handle and a contoured handle surface to allow easy insert to the outer receptacle and easy removal from the outer receptacle. The device replaces conventional trash cans and is useful for recycling.

19 Claims, 5 Drawing Sheets

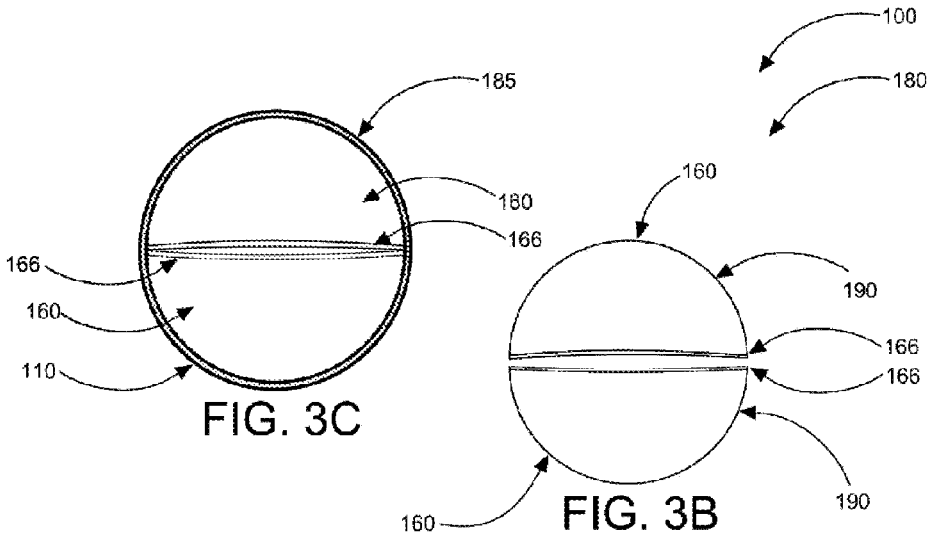
FIG. 3C
FIG. 3B
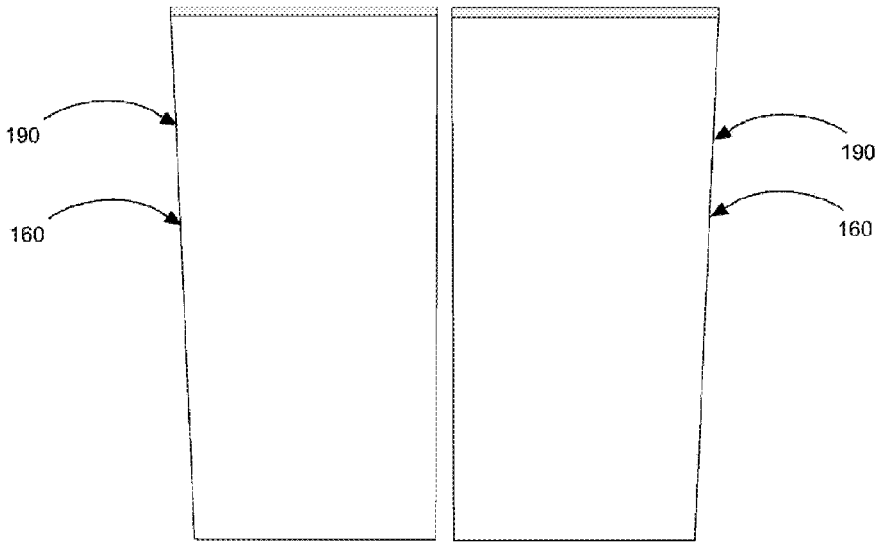
FIG. 3A

DECORATIVE SORT CAN RECYCLING SYSTEM

CROSS-REFERENCE TO RELATED APPLICATION

The present applications are related to and claims priority from prior provisional application Ser. No. 61/509,429 filed Jul. 19, 2011 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of storage containers and more specifically relates to a refuse container system entitled Decorative Sort Can Recycling System.

2. Description of the Related Art

Most of the items consumers buy get discarded into the trash when the item is no longer useful. Operation of landfills is expensive and may be detrimental to the environment. As a result, interest in recycling of household trash has steadily increased in recent years. This interest has grown because of increasing problems associated with solid waste removal. Many communities have evolved to recycling as a means for better managing their garbage as landfills in use for many years have reached their capacity; in many cases it is difficult and expensive for communities to locate space for new landfills. An additional benefit of recycling is that recycling saves energy and raw materials which may help preserve the environment for future generations; this fact is known theoretically, however not well practiced.

Many households are beginning to recycle articles made of glass, aluminum, other metals, plastic and paper. This requires households to set up a method for separating the materials so the items to be recycled are contained separately from refuse destined for the landfill. It is also desirable that recycled materials be separated from each other in the interest of efficiency. In many cases consumers find it easier to throw away recyclable items since it may not be convenient to store them separate from the trash. If multiple containers are used this may require making multiple trips to set out the recyclables for pickup unless all the containers can somehow be carried in one trip. It may also be expensive to purchase numerous containers, such that many consumers may shy away from the expenditure. All of these deficiencies make it burdensome to keep recyclables separate from each other and from other refuse. This may result in having many households collecting their recyclable materials and disposable materials in the same large container; an undesirable condition.

Furthermore, there is currently a disconnect between people's knowledge base about how consumers need to manage natural resources and the tools they have at their disposal. Many times, even though an individual knows an item is recyclable, they still choose to discard the item in the trash because it easier and more convenient. Individuals have tried to incorporate recycling receptacles into their kitchens, or garages; however other areas still lack an appropriate container for recyclable items. Offices, bedrooms, schools, bathrooms, dormitories, hotel rooms, and the like often do not provide an option to recycle. A need exists for an improved, attractive, affordable, and efficient container with a plurality of removable separate inner containers that members of the household can easily and effectively recycle with, and the justification to do so. The need exists for a tool which is sized appropriately for these smaller spaces (bathrooms, bedrooms, offices, hotel rooms, dorms) and is not cumbersome or unattractive. Solving the size and attractiveness problems will allow homeowners to bring the option to recycle into every room of the house, instead of keeping it in hidden, and often far off, areas in the house or outdoors. The container system needed must be thought of as both a décor item, and a functional tool, in order to fit into our living spaces, and bridge the gap that currently exists between wise resource management and our daily behavior in regards to used items in our homes.

The current market offers a few high end, and high priced, generally large, recycling system tools to create a recycling center within the home, though these recycling areas do not currently exist in each room. Currently, recycling areas are located inconveniently away because of the size of receptacles, and the unattractive, non décor related nature of the traditional recycling bin. A smaller, less expensive, and decorative alternative would offer a point of use recycling option to consumers, in each room of the house, and therefore, "catch" many recyclable items that are currently being sent to landfill.

Various attempts have been made to solve the above-mentioned problems such as those found in U.S. Pat. Nos. 5,878,904; D423,168; 4,834,253; 5,390,813; 3,904,218; and D333,369. This prior art is representative of trash cans. None of the above inventions and patents, taken either singly or in combination, is seen to describe the invention as claimed.

Ideally, a refuse container system should provide the capability of storing recyclable and disposable refuse separately, and yet, would operate reliably and be manufactured at a modest expense. Thus, a need exists for a reliable, "every room" refuse container system to provide an efficient, reasonably priced, smaller, and attractive alternative to avoid the above-mentioned problems.

BRIEF SUMMARY OF THE INVENTION

In view of the foregoing disadvantages inherent in the known trash can art, the present invention provides a novel refuse container system. The general purpose of the present invention, which will be described subsequently in greater detail, is to provide a solution to the problem of not being able to conveniently and effectively separate recyclable trash from refuse in every room of the house, at the actual moment items are originally discarded, thus avoiding a build up of unnecessary items to be taken to a landfill in our household trash, or the need for a household member to later go through the trash to separate refuse from recyclables.

According to research, the two main reasons people don't recycle are: 1) lack of convenience, and 2) lack of education about recycling. The present invention serves to address both of these problems. The first, lack of convenience, is addressed by the present invention through its every room size compatibility and its efficient function, as well as its affordability and its built in décor responsive design. The line of recycling tools that grows from the use of the system of the present invention can address all levels of the consumer market, low end and higher end, through its use of varied materials and styles for the outer component, and a built in variance of size and number of inner compartments. The present invention addresses convenience by being appropriate in price, size, and design to be used in every room of the house. The second reason people don't recycle, lack of education about recycling, is addressed in accompanying written material that is part of product identification, marketing, and advertisement. The lack of education is also addressed, through the inherent creation because of the point of use decision that is created by having a recycling tool in every room. The existence of the present invention in every room will necessitate the practice of product checking by each consumer. Consumers will become accustomed to making a determination as to whether each product is landfill material or reuse material, thus experiencing a self-driven recycling education. This repeated, brief moment of consideration is intended to produce an eventual, and overall change in how consumers think of used items. As such, the everyday, every room trashcan may be replaced with an attractive recycling tool. The refuse container system is a décor item suitable for use in recycling such that one may be placed into every room of a residence or other venue, so people no longer have to go to the garage, kitchen, work station, etc. in order to send materials back into use through recycling, instead of throwing them away. The device is designed to be aesthetic, discreet, educational and motivational in nature.

A refuse container system is disclosed, in a preferred embodiment, comprising an outer receptacle in the shape of a slightly tapered cylinder. The outer receptacle comprises a top opening (circular in shape) and an inner body comprising an inner surface and an outer surface. The body of the outer receptacle comprises a circular bottom and a receptacle-wall about the periphery of the circular bottom; together forming an inner surface. The outer receptacle comprises an inner volume defined by the inner surface of the receptacle-wall. The inner volume is able to receive cylindrical troughs (inserts) with half-moon profiles, the inserts comprising a taper as well as the outer receptacle. The bottom of these inserts each comprise a half moon-shaped lower-wall. This half moon-shaped lower-wall joins a flat-wall and an acuate-wall, these in combination defining a space for storing recyclables therein. The top end of each inner insert comprises of half moons as well, though the contour of the top rim has been adjusted in order to provide a small space between the handle surfaces. This contoured meeting of the inner receptacles along the handles surface is designed to increase ease of use by the user. This feature, referred to as the easy grab contoured handles, increases user ease and maneuverability while using one hand.

The flat bottom of the outer receptacle is preferably raised off the floor through existence of a small raised diameter rim employed on the bottom surface. Smooth, slightly rounded edges may be found on the consumer contact points of each liner and along the whole edge of the hand cutout and contoured top surface of the handling surface, all to enhance comfort of use during user manipulation of the two liner components. The preferred dimensions of this particular preferred embodiment are about 11 inches top diameter by about 11 inches high, with a slight inward taper towards the bottom diameter of 10 inches so as to aide in smooth replacement of the liners, and increase the stability of a single liner which must stand alone when user opts to empty just one liner. The outer receptacle of the system can be constructed of a wide variety of materials (woven wicker, metal, wire mesh, wood, paper, seagrass, plastic, paper, ceramic etc.) in order to maintain its function as a décor item. The outer receptacle will vary in both color and material in various embodiments. The system allows for variation in overall size, shape, and number of inner receptacle compartments. Optional eco-friendly liner bags such as compostable and specially fitted freestanding paper bag; or cloth, reusable bags with a specially designed fastener system that keeps bag in place wash after wash may also be used in conjunction with the present invention.

In alternate embodiments of the refuse container system, comprising an outer receptacle, the receptacle may be square, or rectangular. In the square embodiments, the outer receptacle may be constructed of many different materials including plastic, wicker, bamboo, wood, metal, ceramic, or it may comprise a cabinet with legs to elevate the refuse container system above the planer surface on which it sits (floor/ground or the like). The outer receptacle, in this embodiment, comprises a top opening and an inner body comprising an inner surface and an outer surface. The body of the outer receptacle in this particular embodiment comprises a first wall, a second wall, a third wall, a fourth wall, and a fifth wall. The outer receptacle comprises an interior cavity defined by the inner surface. In this embodiment, the outer receptacle may comprise an optional lid for enclosing the interior cavity to visibly hide refuse and potentially to contain odors.

In the square and rectangular embodiments, contained within the outer receptacle are two or more nestable and duplicate interior recycle can inserts (mirroring, or repeating one another). Each interior recycle can insert comprises a right sidewall, a left sidewall, a front sidewall, a rear sidewall, and a lower sidewall which define the parameters of the body of the interior recycle can inserts. Each of the interior recycle can inserts comprises an upper periphery and a lower periphery. The upper periphery of the interior recycle can inserts may comprise a rimmed distance (measured around) greater than the lower periphery such that the interior recycle can inserts have a slight taper inwardly toward the lower periphery. Each of the right sidewall and left sidewall of the interior recycle can inserts preferably comprise cut-out handle slots for lifting the recycle can via the inserts from the refuse container system. Each of the interior recycle can inserts may comprise air holes to provide for ventilation to equalize relative air pressure such that the interior recycle can inserts are easily removable from the outer receptacle (not resistance-held by vacuum.) The two or more nestable and duplicate interior recycle can inserts are insertable and removably storable within the outer receptacle inside the interior cavity via the top opening.

The refuse container system does not comprise a spacer plate for holding the interior recycle can inserts concentrically within the outer receptacle in preferred embodiments. Rather, the two nestable and duplicate interior recycle can inserts fit down into the outer receptacle such that they are flush (or nearly flush) with the top opening of the outer receptacle of the refuse container system, providing a neater profile that occupies less space and is easier to keep clean, cheaper to manufacture, ship, and the like. Each of the two nestable and duplicate interior recycle can inserts are able to be picked up either separately, or in unison, via one hand of a user. The two nestable and duplicate interior recycle can inserts comprising rigid material sufficient to retain its original contour when in a loaded and unloaded condition. Further, the interior recycle can inserts are not rotatably mounted about the outer receptacle.

The cut-out handle slots comprise openings suitable, and designed for a hand of a user to comfortably grip the interior recycle can inserts for ease of removal of the interior can inserts from the outer receptacle to be emptied of the trash or recyclables contained therein.

The carefully contoured profile of the back to back handle surfaces creates a small space where the inserts meet. This feature, referred to as the easy grab contoured handles, allows for enhanced one-handed maneuverability and manipulation of the inserts by the user.

The air holes of the interior recycle can inserts provide ventilation to equalize relative air pressure such that the interior recycle can inserts are easily removable from the outer receptacle. The nestable and duplicate interior recycle can inserts in combination with the outer receptacle form the refuse container system useful for sorting, storing and discarding refuse.

The present invention holds significant improvements and serves as a refuse container system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, refuse container system, constructed and operative according to the teachings of the present invention.

FIG. 3A is a top view illustrating the cylindrical-shaped outer receptacle having a rim according to an embodiment of the present invention of FIGS. 1-2.

FIG. 3B is a top view illustrating two of the half-moon inserts according to an embodiment of the present invention of FIGS. 1-2.

FIG. 3C is a side view illustrating the half-moon inserts (taper shown) according to an embodiment of the present invention of FIGS. 1-2 and 3B.

The various embodiments of the present invention will hereinafter be described in conjunction with the appended drawings, wherein like designations denote like elements.

DETAILED DESCRIPTION

Figure 1:
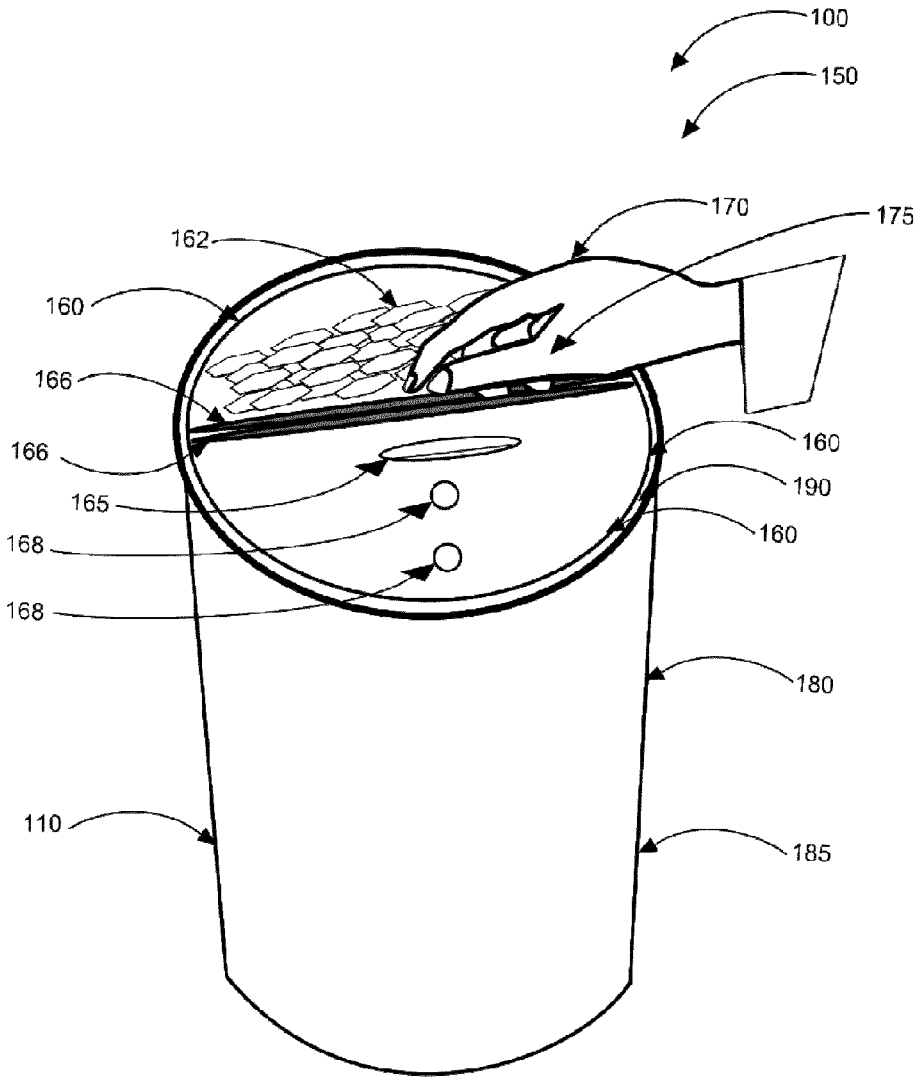
FIG. 1 shows a perspective view illustrating a refuse container system (cylindrical embodiment) in an in-use condition according to an embodiment of the present invention.

As discussed above, embodiments of the present invention relate to a recycle can device and more particularly to a refuse container system as used to improve the storage and removal of recyclable and disposable refuse.

Generally speaking, the refuse container system along with the outer receptacle and two nestable and duplicate interior recycle can inserts provides households with a suitable means for separating their recyclable refuse from their disposable refuse in every room. The invention is preferably comprised of a tapered cylindrical version. Within the device are stored two nestable and duplicate interior recycle can inserts; one interior recycle can insert may be used to store recyclable refuse and the second interior recycle can insert may be used to store disposable refuse (or vice versa). Alternately, they may both be used for trash or both for recyclables. Various embodiments may comprise more than two inserts. Each of the interior recycle can inserts preferably has a tapered wall to facilitate easy insertion and removal of the interior recycle can insert(s) from the outer receptacle (cabinet). Each of the interior recycle can inserts also has comfortable cut-out handles placed within the specifically contoured handle surface, and sit back to back to create a maneuverability enhancing space between the handle surfaces.

A further enhancement to the inner recycle can inserts is a series of air holes to equalize the relative air pressure (eliminate vacuum) within the outer receptacle (cabinet) such that the interior recycle can inserts are easily removable from the cylindrical exterior.

A further enhancement of the refuse container system is that the outer receptacle may comprise several decorative options, such as dark or light wicker, dark or light wood, chrome, industrial finished metal, brushed nickel finished metal, wire mesh, pattern punched tin or hammer finished metal, plastic in a variety of colors and textures, eco-options such as bamboo or paper, and high-end finishes combining metal and ceramic or all ceramic. Color options are also available including pastel colors, bright colors and neutral colors. Finishes, colors, and materials will change to reflect décor tastes and trends, in order to retain the system's relevance as a décor item.

The "SortCan" recycling system not only allows for decorative variances, but provides for, and encourages the individual consumer's creativity/preference building. Because the liners can come in many colors and configurations, and the outer receptacles can be made of many different colors, materials and configurations, each consumer can take advantage of the many options, and actually build their own "SortCan" system. For instance, a consumer may choose two different liner colors, and a square wicker outer receptacle. Another consumer may design their "SortCan System" using two, like colored circular liners, and a plastic outer receptacle. Still another may choose three inner compartments, with a rectangular outer receptacle made of metal in an industrial looking finish. Yet another consumer builds a small ceramic, countertop version with just two liners, and matching lids. The possibilities are endless, and the choices can be made by the consumers, in order that each consumer designs the best tool for his or her room, needs, and preferences. In the market place, the "SortCan" display area becomes not only an area to display prebuilt options, but a place where consumers can build and design their own product.

Referring now to the drawings by numbers of reference there is shown in FIGS. 1-3C, perspective views illustrating refuse container system 100 (specifically cylindrical embodiment, cylindrical design 180) in an in-use condition according to an embodiment of the present invention.

A preferred embodiment of refuse container system 100 comprises a substantially cylindrical design 180 (but with a tapered profile). Refuse container system 100 interior recycle can inserts 160 in this particular embodiment comprise a 3-D half-moon profile (cylindrical troughs 190.) Outer receptacle 110 comprises a cylinder 185, as shown. Refuse container system 100 interior recycle can inserts 160 comprise cylindrical troughs 190 such as to occupy the interior of cylinder 185. Cylindrical troughs 190 each comprise exactly one of cut-out handle slots 165; and one specifically contoured handle surface 166. Refuse container system 100 interior recycle can inserts 160 may comprise recycled plastic 169. Recycled plastic 169 is preferably used for the material such that the present invention 'practices what it preaches' to develop loyalty in its users 170. Other suitably equivalent materials may be used in alternate embodiments.

Figure 2:
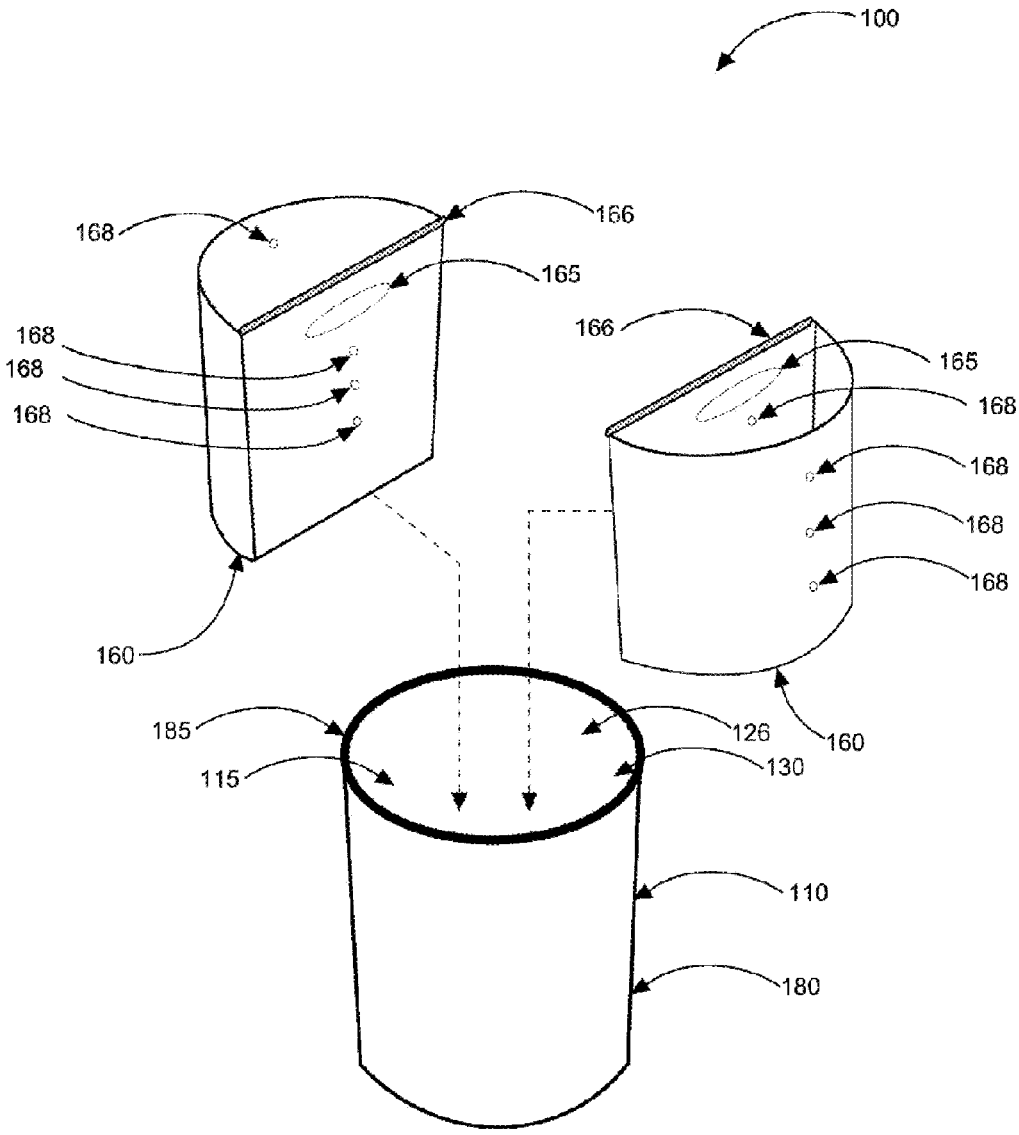
FIG. 2 is an exploded view illustrating half-moon inserts that are nestable within a cylindrical-shaped outer receptacle according to an embodiment of the present invention of FIG. 1.

FIG. 2 is an exploded view illustrating the half-moon inserts (preferably tapered) (a version of interior recycle can inserts 160) that are nestable within a cylindrical-shaped outer receptacle (cylinder 185) according to an embodiment of the present invention of FIG. 1. Cylindrical troughs 190 are shown to be insertable into cylinder 185 and are removable as also indicated via dotted lines. This particular embodiment of circular design 180 is preferred since it is similar to its predecessor 'the conventional trash can' such that consumers aren't dissuaded from its use; however it is also improved in that it provides added function as a refuse sorting tool. The top rim of cylinder 185 is also shown in the present figure and in FIG. 3A. FIG. 3A is a top view illustrating the cylindrical-shaped outer receptacle (cylinder 185) having a rim according to an embodiment of the present invention of FIGS. 1-2.

FIG. 3B is a top view illustrating two of the half-moon inserts (interior recycle can inserts 160) and the contoured back-to-back surfaces (which allow for ease of grasping interior recycle can inserts 160) according to a preferred embodiment of the present invention of FIGS. 1-2. Interior recycle can inserts 160 are insertable and removable as shown in FIG. 2 in the orientation as shown in FIG. 3A. FIG. 3C is a side view illustrating the half-moon inserts version of interior recycle can inserts 160 (taper indicated) according to an embodiment of the present invention of FIGS. 1-2 and 3B.

Figure 4B:
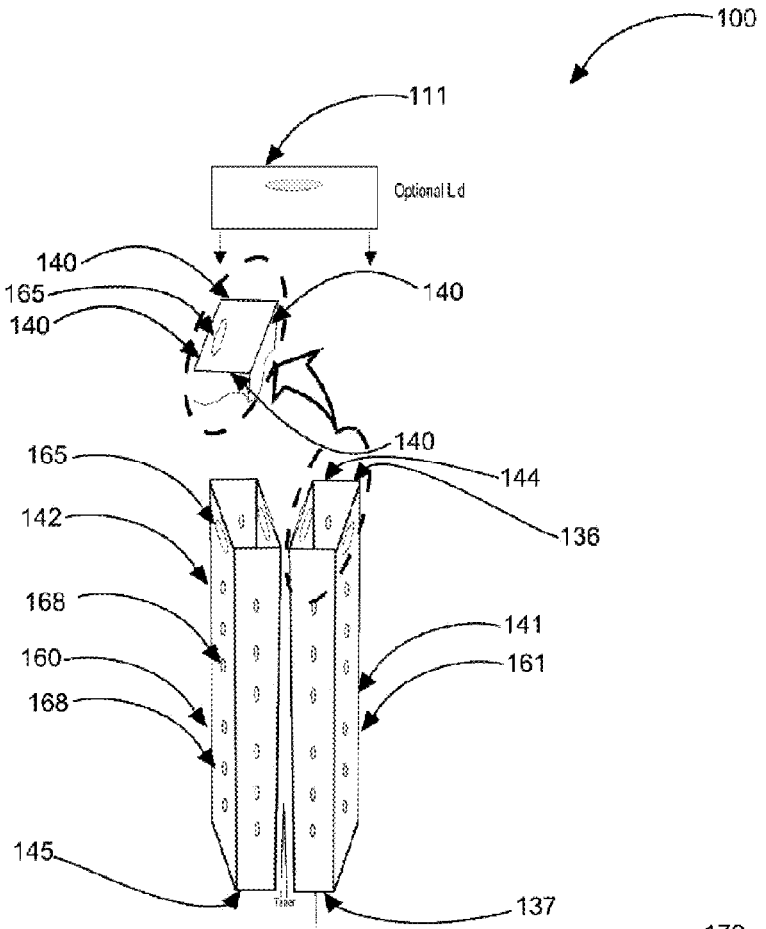
FIG. 4B is a perspective view illustrating an alternate embodiment of the refuse container system of the present invention (in-use) of FIGS. 1 and 4A.
Figure 4A:
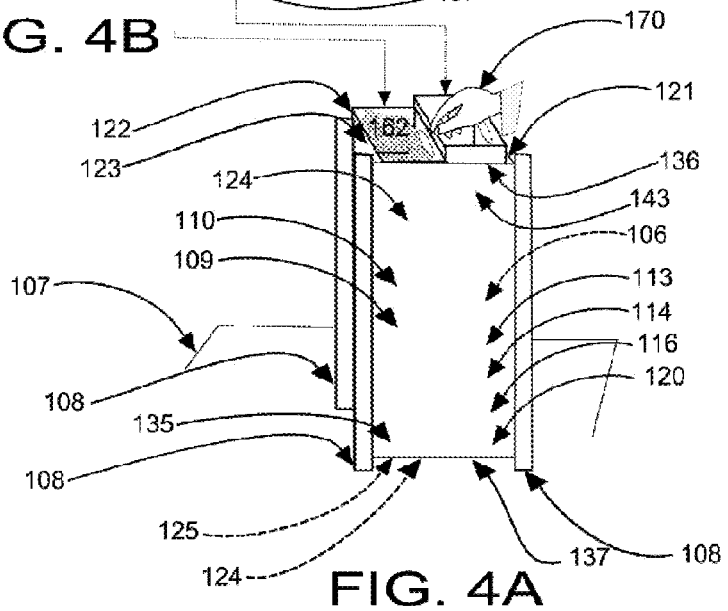
FIG. 4A is a perspective view illustrating the inserts of an alternate embodiment of the refuse container system of the present invention of FIG. 1.

FIGS. 4A-4B are perspective views illustrating interior recycle can inserts 160 of an alternate embodiment of refuse container system 100 of the present invention of FIG. 1. FIG. 4B illustrates refuse container system 100 in an in-use condition 150 with user 170 removing inner recycle can inserts 160 according to an embodiment of the present invention.

Refuse container system 100 is shown sitting on planer surface 107 comprising outer receptacle 110. Outer receptacle 110 in-turn may comprise furniture item 116 (cabinet or square item) which may be manufactured in various decorative styles. Outer receptacle 110 comprises top opening 115 and upper periphery 136 and lower periphery 137. Outer receptacle 110 also comprises body 120. Body 120 comprises inner surface 130 and outer surface 135. First wall 121, second wall 122, third wall 123, fourth wall 124, and fifth wall 125 define parameters of body 120 (more walls and different orientation than found in circular design 180 of FIG. 2.)

First wall 121, second wall 122, third wall 123, and fourth wall 124 comprise enclosure-walls 140; second wall 122, and fourth wall 124 comprising side enclosure-walls 140; fifth wall 125 comprises lower wall 145. Body 120 comprises interior cavity 126 further comprising inner surface 130. Refuse container system 100 does not comprise spacer plate for holding interior recycle can inserts 160 concentrically within outer receptacle 110. In this way the present invention is cost-efficient to manufacture and contains a minimum of components. Refuse container system 100 preferably comprise two nestable and duplicate interior recycle can inserts 160 fitting down into outer receptacle 110 such that they are flush, or nearly flush, with top opening 115 of outer receptacle 110 of refuse container system 100. In this way the present invention is relatively low in profile such that it may be fit into small spaces.

As in the preferred version, the purpose of the present invention is to help a user 170 separate their refuge 162 between recyclable refuge 162 and disposable refuse 162 and/or recyclable refuge 162 from other recyclable refuge 162 (for example plastic from paper or aluminum.) This is accomplished by providing two (or more) nestable and duplicate interior recycle can inserts 160, as previously mentioned to fit within outer receptacle 110. Preferably two nestable and duplicate interior recycle can inserts 160 store refuse 162; one interior recycle can insert 160 may store recyclable refuse 162 and one interior recycle can insert 160 may store disposable refuse 162 or alternate combination thereof. Nestable and duplicate interior recycle can inserts 160 are each able to be picked up separately via one hand of user 170. As in the previous embodiment, both duplicate interior recycle can inserts 160 preferably comprise rigid material such as plastic 114 sufficient to retain its original contour when in a loaded and unloaded condition making them sufficiently durable in use. Refuse container system's 100 interior recycle can inserts 160 are not rotatably mounted about outer receptacle 110. Interior recycle can inserts 160 may comprise a rhomboid or other such suitable shape of a profile to insert into outer receptacle 110.

Two nestable and duplicate interior recycle can inserts 160 are insertable and removably storable within outer receptacle 110 in interior cavity 126 via top opening 115 where they may be removed from or inserted therein. Each of duplicate interior recycle can inserts 160 comprise right sidewall 141, left sidewall 142, front sidewall 143, rear sidewall 144, and lower wall 145; thereby defining enclosure-walls 140 of interior recycle can inserts 160. Nestable and duplicate interior recycle can inserts 160 comprise upper periphery 136 comprising a rimmed distance greater than around lower periphery 137 such that interior recycle can inserts 160 have a slight taper inwardly toward lower periphery 137. This feature makes it easier to remove and insert interior recycle can inserts 160.

Nestable and duplicate interior recycle can inserts 160 comprise cut-out handle slots 165 which comprise openings suitable for a hand of a user 170 to grip interior recycle can inserts 160 permitting removal of interior recycle can inserts 160 from outer receptacle 110 to be emptied of refuse 162 contained therein. Nestable and duplicate interior recycle can inserts 160 preferably comprise air holes 168 to provide ventilation to equalize relative air pressure such that interior recycle can inserts 160 are easily removable from outer receptacle 110. Nestable and duplicate interior recycle can inserts 160 in combination with outer receptacle 110 form refuse container system 100 useful for holding and intermittently discarding refuse 162.

Outer receptacle 110, if comprising a furniture item 116, may comprise wood 113 in alternate embodiments and may comprise other suitably equivalent materials such as composites, metals, and the like in others. Outer receptacle 110 comprising furniture item 116 may comprise plastic 114 for example. Outer receptacle 110 of refuse container system 100 in alternate versions may comprise cabinet 109. Refuse container system 100 cabinet 109 may comprise legs 108 elevating refuse container system 100 above a planer surface 107. Refuse container system 100 outer receptacle 110 comprises a rectangular parallelepiped 106 in FIGS. 4A and 4B (alternate embodiment.) An optional lid 111 may be included for use with outer receptacle 110. As mentioned, this featured option may help the aesthetics and may also help contain odors, keep animals and children out and the like.

Each of interior recycle can inserts 160 within this particular embodiment comprise a right sidewall 141, a left sidewall 142, a front sidewall 143, a rear sidewall 144, a lower sidewall 145, an upper periphery 136 and a lower periphery 137. Interior recycle can inserts 160 are slightly tapered, as previously mentioned. Interior recycle can inserts 160 comprise cut-out handle slots 165 and air holes 168 in preferred embodiments of this embodiment as well as in preferred embodiments. Refuse container system 100 may comprise cut-out handle slot 165 of left sidewall 142 of interior recycle can insert 160 and may also comprise a specifically contoured handle surface 166. Refuse container system 100 right sidewall 141 of interior recycle can inserts 160 comprises one of cut-out handle slots 165, as does left sidewall 142. FIG. 4A, shows a perspective view of a top of nestable interior recycle can insert 160 comprising enclosure-walls 140 comprising right sidewall 141, left sidewall 142, front sidewall 143 and rear sidewall 144. The top is preferably open so refuse may be dropped in.

Refuse container system 100 according to an embodiment of the present invention of FIGS. 1-4B, may be sold as kit 450 comprising the following parts: at least one outer receptacle 110; at least two nestable interior recycle can inserts 160; and at least one Decorative Sort Can Recycling System logo educational/motivational labeling strip, comprised of recycled cardboard (front and back justifying use of recycle container). Optional stickers for consumer to use in marking the inner receptacles for intended use may be included.

Front Decorative Sort Can Recycling System logo may comprise the following indicia: I'd like to thank you for purchasing a Decorative Sort Can Recycling System and making a commitment to send each recyclable item you use towards its next product life, instead of letting it go to landfill. Each item, each person, each choice, is a catalyst toward change, and your decision to recycle in every room is more powerful than you might think. You are part of the growing number of people who are actively reshaping the way humanity thinks about and uses the earth's resources. (signature of owner/inventor) LOOK AT THE CHART BELOW IF YOU'D LIKE TO LEARN ABOUT SOME OF THE NEXT-LIFE PRODUCTS THAT YOUR USED PLASTIC ITEMS CAN BECOME.

| #s | COMMON USES | CAN BE RECYCLED INTO | No. & Name |
|---|---|---|---|
| 1 | water & soda bottles, food jars (peanut butter, jelly) microwavable food trays | new water and soda bottles, clothing; including fleece, and other textiles, fiberfill for jackets and sleeping bags, carpet, duffle bags and backpacks, shoe laces, door mats, cell phone cases | PET |
| 2 | milk bottles, yogurt and margarine tubs, detergent bottles, cereal box liners, shampoo bottles, grocery bags | new plastic bottles, lawn chairs, garden edging, toys, composite lumber for decking, fences, and railing, birdfeeders, playground equipment, picture frames spray bottles, wall anchors | HDPE |
| 3 | plastic food wrap, vegetable oil bottles, loose-leaf binders, plastic pipes, blister packs, clamshells | roadbeds, roofing materials, floorcoverings, garden furniture, checkbook covers, piping products, hotel key cards, ID badges | PVC |
| 4 | polybags (used in retail shipping) dry cleaning bags, produce bags, bread bags, squeezable bottles (like for mustard) | plastic lumber & fencing, garden hoses, floor tiles, bike racks, plastic cones, cables, kitchen utensils, reusable totes, trashcans, pallets, new trash bags | LDPE |
| 5 | ketchup & syrup bottles, medicine bottles, containers for yogurt & cottage, cheese, drinking straws, plastic bottle caps | cutting boards, cutlery, toothbrushes, pill boxes, plastic funnels & spouts, compost bins, cell phone covers, party plates, 5 gallon containers and jugs, compost bins | PP |
| 6 | foodservice trays, and to go containers meat trays, egg cartons protective packing for computers, furniture, electronics, ice chests, aspirin bottles, cutlery | rulers, clipboards, pens, computer casings, picture frames, door trim, crown molding, baseboards, surfboards CD casings, garden pots nursery flats, | PS |
| 7 | items that don't fit into categories 1-6, including 5 gallon water bottles and some kitchen storage containers | not as easily recycled | |

Reused and recycled plastic is even being used to build bridges, railroad ties, boardwalks, car bumpers, bicycles, boats, docks, and buildings!

Because 7 to 8% of the earth's fossil fuels are used to produce plastic, it might make you happy to know that your Decorative Sort Can Recycling System liners are made of 100% post consumer, recycled plastic!

(Back) Decorative Sort Can Recycling System logo: Here are some interesting, and possibly surprising facts:

Landfills are specifically designed to prevent decomposition, so once something goes into a landfill, it doesn't come out, even if that product says "biodegradable".

The words "biodegradable" and "compostable" do not mean the same thing, but if you want your compostable items to return to soil, you can compost at home, or find a facility that is certified to do so.

Paper products make up the largest percentage of waste to landfills (33%) even though all dry, non-greasy, non-wax-coated paper and cardboard items are recyclable.

Approximately 1 billion trees worth of paper are thrown away every year in the U.S.

Making new paper from recycled paper uses 30-50% less energy than making paper from trees and it reduces contributions to air pollution by 95%.

Every ton of recycled office paper saves 380 gallons of oil.

It takes 95% less energy to make aluminum from scrap.

Recycling one aluminum can saves the energy equivalent of a ½ gallon of gas.

The average number of plastic bottles consumed in the U.S. every minute is 400,000.

In the U.S., in 2011, waste-diversion efforts (recycling rates) were at 33%.

For every job collecting recyclables, there are 26 jobs in processing the materials and manufacturing them into new products.

A 75% recycling rate in the US alone would create over 1.5 million jobs.

Reaching a 75% recycling rate in the US would reduce carbon emissions by 276 million metric tons by 2030, the equivalent of taking 50 million cars off the road!

The above recycling facts, will change as time moves on, and manufacturing technologies/practices change, so the above product marketing/labeling educational strip will be a fluid document.

Refuse container system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, different shapes, more or less inserts, parts may be sold separately, etc., may be sufficient.

Figure 5:
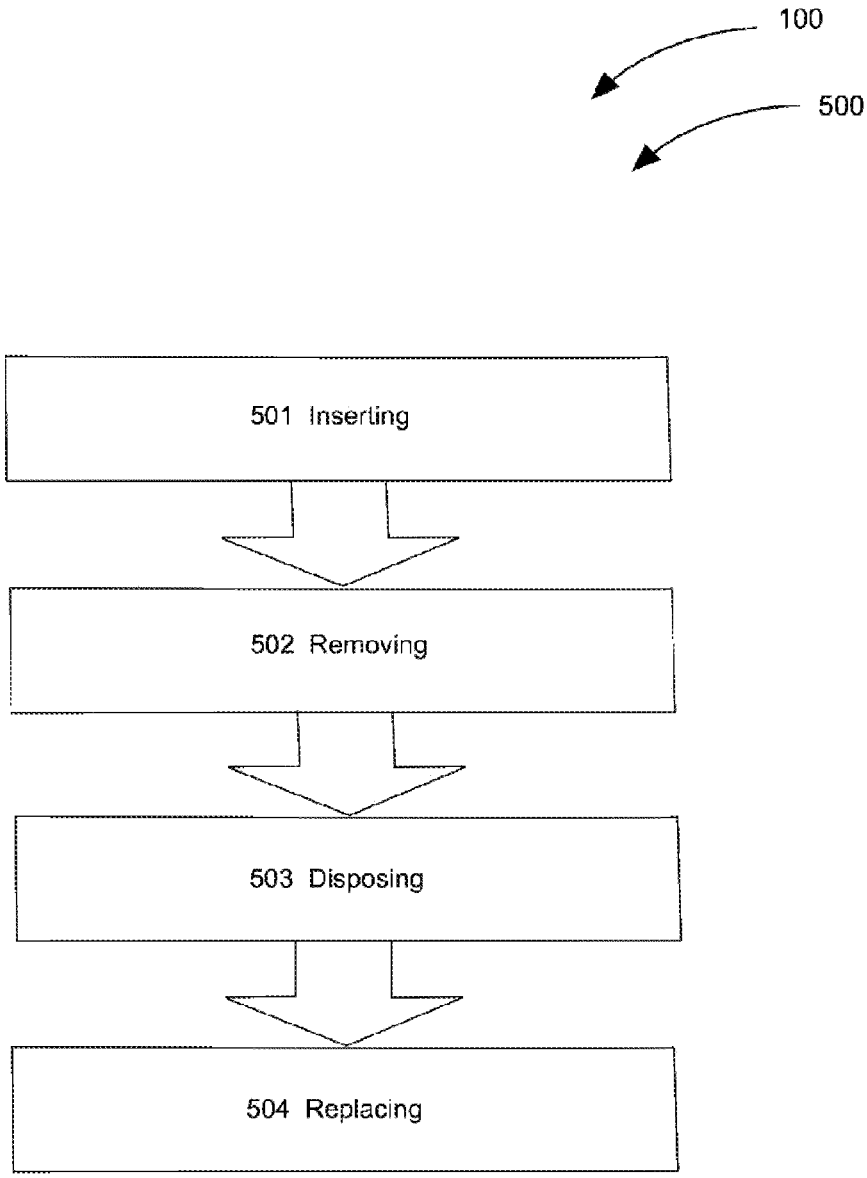
FIG. 5 is a flowchart illustrating a method of use of the refuse container system according to an embodiment of the present invention of FIGS. 1-4B.

Referring now to FIG. 5, showing a flowchart illustrating a method of use 500 for refuse container system 100 according to an embodiment of the present invention of FIGS. 1-4B.

A method of use 500 for refuse container system 100 may comprise the steps of: step one 501 inserting two nestable interior recycle can inserts 160 into outer receptacle 110; step two 502 removing one or two nestable interior recycle can inserts from outer receptacle 110; step three 503 disposing of refuse 162 (emptying separated recycled materials) from nestable interior can insert(s) 160; and step four 504 replacing nestable interior recycle can insert(s) 160 into outer receptacle 110.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A refuse container system comprising:
an outer receptacle having;
a top opening; and
a body having;
an inner surface;
an outer surface forming a cylinder; and
an interior cavity defined by said inner surface; and
two nestable and duplicate interior recycle can inserts;
each of said interior recycle can inserts comprising cylindrical troughs each having;
a half moon-shaped lower-wall joining a flat-wall and an acuate-wall;
an upper periphery;
a lower periphery;
cut-out handle slots;
contoured handle surface; and
air holes;
wherein said two nestable and duplicate interior recycle can inserts are insertable and removably storable within said outer receptacle in said interior cavity via said top opening;
wherein said cylinder defines said body;
wherein said half moon-shaped lower-wall joining said flat to contoured-wall and said acuate-wall comprise enclosure-walls;
wherein said enclosure-walls define outer confines of said interior recycle can inserts;
wherein said upper periphery comprises a rimmed distance greater than said lower periphery such that said interior recycle can inserts have a slight taper inwardly toward said lower periphery;
wherein said cut-out handle slots comprise openings suitable for a hand of a user to grip said interior recycle can inserts for removal of said interior recycle can inserts from said outer receptacle to be emptied of refuse contained therein;
wherein said air holes of said interior recycle can inserts provide ventilation to equalize relative air pressure such that said interior recycle can inserts are easily removable from said outer receptacle; and
wherein said nestable and duplicate interior recycle can inserts in combination with said outer receptacle form said refuse container system useful for holding and intermittently discarding of said refuse.

2. The refuse container system of claim 1 wherein said refuse container system does not comprise a spacer plate for holding said interior recycle can inserts concentrically within said outer receptacle.

3. The refuse container system of claim 1 wherein said two nestable and duplicate interior recycle can inserts are each able to be picked up separately and together, via one hand of said user, said two nestable and duplicate interior recycle can inserts comprising rigid material sufficient to retain its original contour when in a loaded and unloaded condition.

4. The refuse container system of claim 1 wherein said interior recycle can inserts are not rotatably mounted about said outer receptacle.

5. The refuse container system of claim 1 wherein said interior recycle can inserts are designed to separate recyclables.

6. The refuse container system of claim 5 further comprising a logo with indicia related to information pertaining to recycling benefits.

7. The refuse container system of claim 6 wherein said interior recycle can inserts each comprise exactly one of said cut-out handle slots.

8. The refuse container system of claim 1 wherein said outer receptacle comprises a furniture item comprising wood.

9. The refuse container system of claim 1 wherein said outer receptacle comprises a plastic.

10. The refuse container system of claim 9 wherein each of said interior recycle can inserts comprise recycled plastic.

11. The refuse container system of claim 1 wherein said outer receptacle comprises a woven wicker.

12. The refuse container system of claim 1 wherein said outer receptacle comprises seagrass.

13. The refuse container system of claim 1 wherein said outer receptacle comprises metal.

14. The refuse container system of claim 1 wherein said outer receptacle comprises paper.

15. The refuse container system of claim 1 wherein said outer receptacle comprises ceramic.

16. The refuse container system of claim 1 wherein said outer receptacle comprises wire mesh.

17. A refuse container system comprising:

outer receptacle having;

a top opening; and a body having;

an inner surface;

an outer surface, said body comprising a first wall, a second wall, a third wall, a fourth wall, and a fifth wall; and an interior cavity defined by said inner surface; and two nestable and duplicate interior recycle can inserts;

each of said interior recycle can inserts having;

a right sidewall, a left sidewall, a front sidewall, a rear sidewall, and a lower sidewall;

an upper periphery;

a lower periphery;

cut-out handle slots; and air holes;

wherein said two nestable and duplicate interior recycle can inserts are insertable and removably storable within said outer receptacle in said interior cavity via said top opening;

wherein said first wall, said second wall, said third wall, said fourth wall, and said fifth wall define parameters of said body;

wherein said first wall, said second wall, said third wall, and said fourth wall comprise enclosure-walls;

wherein said second wall, and said fourth wall comprise side enclosure-walls;

wherein said fifth wall comprises a lower wall;

wherein said upper periphery, said lower periphery, said right sidewall, said left sidewall, said front sidewall, said rear sidewall, and said lower sidewall define outer confines of said interior recycle can inserts;

wherein said upper periphery comprises a rimmed distance greater than said lower periphery such that said interior recycle can inserts have a slight taper inwardly toward said lower periphery;

wherein said cut-out handle slots comprise openings suitable and specifically designed for a hand of a user to grip said interior recycle can inserts for removal of said interior recycle can inserts from said outer receptacle to be emptied of refuse contained therein;

wherein said air holes of said interior recycle can inserts provide ventilation to equalize relative air pressure such that said interior recycle can inserts are easily removable from said outer receptacle; and wherein said nestable and duplicate interior recycle can inserts in combination with said outer receptacle form said refuse container system useful for holding and intermittently discarding of said refuse.

18. The refuse container system of claim 17 wherein said outer receptacle comprises a rectangular parallelepiped.

19. The refuse container system of claim 17 wherein said interior recycle can inserts comprise a rhomboid.

* * * * *